US005318939A

United States Patent [19]

Laver et al.

[11] Patent Number: 5,318,939

[45] Date of Patent: Jun. 7, 1994

[54] PRESSURE-SENSITIVE OR HEAT-SENSITIVE RECORDING MATERIAL

[75] Inventors: Hugh S. Laver, Fribourg; Mario Slongo, Tafers, both of Switzerland

[73] Assignee: Ciba-Geigy Corporation, Ardsley, N.Y.

[21] Appl. No.: 758,931

[22] Filed: Sep. 11, 1991

[30] Foreign Application Priority Data

Sep. 17, 1990 [CH] Switzerland ..... 3003/90-6

[51] Int. Cl.[5] ..... B41M 5/132; B41M 5/30

[52] U.S. Cl. ..... 503/209; 503/221; 503/226

[58] Field of Search ..... 503/209, 228, 215, 221

[56] References Cited

U.S. PATENT DOCUMENTS

| | | | |
|---|---|---|---|
| 3,615,533 | 10/1971 | Rauner | 430/346 |
| 3,860,425 | 1/1975 | Ono et al. | 96/82 |
| 4,045,229 | 8/1977 | Weber, II et al. | 430/512 |
| 4,486,762 | 12/1984 | Okamoto et al. | 503/226 |
| 4,921,832 | 5/1990 | Adair et al. | 503/201 |
| 5,096,781 | 3/1992 | Vieira et al. | 503/209 |

FOREIGN PATENT DOCUMENTS

| | | |
|---|---|---|
| 2816226 | 10/1978 | Fed. Rep. of Germany . |
| 2150505 | 4/1973 | France . |

OTHER PUBLICATIONS

Patent Abstract, vol. 9, 261, 60-107388.
Derwent 88-283046/40.
Derwent 89-003820/01.
Derwent 89-011895/02.

*Primary Examiner*—Pamela R. Schwartz
*Attorney, Agent, or Firm*—William A. Teoli, Jr.; Luther A. R. Hall

[57] ABSTRACT

Compounds of formula

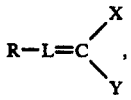

wherein R, L, X and Y are as defined in claim 1, are very suitable for use as UV absorbers in pressure-sensitive or heat-sensitive recording materials.

17 Claims, No Drawings

PRESSURE-SENSITIVE OR HEAT-SENSITIVE RECORDING MATERIAL

The present invention relates to sensitive or heat-sensitive recording materials.

Heat-sensitive recording materials are normally prepared by applying to the surface of a substrate such as paper a coating composition comprising a mixture of a dispersion of a colourless chromogen (colour former) and a dispersion of a colour developer as-electron acceptor. Other auxiliaries such as iffers and heat stabilisers are usually also added. When heat is applied, a chemical reaction takes place between the chromogen and the colour developer in the coating composition to form a colour.

In pressure-sensitive recording materials, the colour former is also formed by a reaction between the chromogen and the electron acceptor. In contrast to the heat-sensitive recording materials, the colour former is dissolved in an oil and microencapsulated. The microcapsules are dispersed in a suitable binder solution, and the resultant dispersion is applied to a substrate. The colour developer is likewise applied in the form of a dispersion to a second substrate. Both substrates are then brought into contact such that, by exerting pressure on this material, the colour former liberated from the microcapsules, together with the colour developer, is able to form a dye.

It is known that light acting on pressure-sensitive recording materials can very easily break down the colour former to form reddish-brown decompositions products. The resultant discolouration of the recording materials is naturally highly undesirable. Furthermore, such materials when used later may develop no, or only insufficient, colour densities.

These phenomena also occur in heat-sensitive recording materials, although to a lesser extent.

It is therefore the object of the present invention to provide pressure-sensitive or heat-sensitive recording materials which are substantially protected against the action of light. This object is achieved in the practice of this invention by using a certain class of UV absorbers.

Specifically, the invention relates to a pressure-sensitive or heat-sensitive recording material containing on a support (a) a colour former and (b) a colour developer, which comprises, additionally, as UV -absorber (c), at least one compound of formula

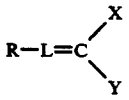

(1)

wherein

X and Y are each independently of the other alkoxy of 1 to 12 carbon atoms, phenyl, phenyl which is substituted by alkyl or alkoxy, each of 1 to 12 carbon atoms, or by halogen, or are $—COR_1$, $—CO_2R_1$, $—SO_2R_2$, $—P(O)(OR_3)2$ or cyano, or, when taken together, form a group of formula $—CO—O—C_nH_{2n}—O—CO—$, L is a group of formula —CH=or —N=, and R is a group of formula

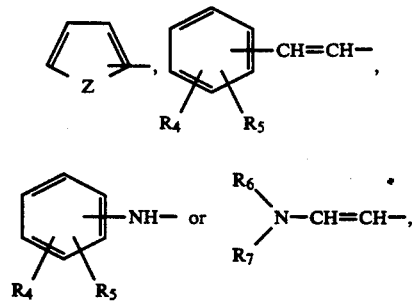

wherein $R_1$ is hydrogen, alkyl of 1 to 12 carbon atoms, alkenyl of 2 to 12 carbon atoms or phenyl, n is an integer from 1 to 5, $R_2$ is hydrogen, alkyl of 1 to 12 carbon atoms or phenyl, $R_3$ is alkyl of 1 to 12 carbon atoms, Z is —NH—, —O— or —S—, $R_4$ and $R_5$ are each independently of the other hydrogen, alkyl or alkoxy, each of 1 to 12 carbon atoms, alkoxycarbonyl containing 1 to 18 carbon atoms in the alkoxy moiety, hydroxyl or halogen, and $R_6$ and $R_7$ are each independently of the other hydrogen, alkyl of 1 to 12 carbon atoms or, together with the linking nitrogen atom, form a morpholine, piperidine or piperazine radical.

In formula (1) above, the substituents X and Y are each independently of the other alkoxy of 1 to 12 carbon atoms, typically methoxy, ethoxy, propoxy and butoxy, pentoxy, hexoxy, octoxy and dodecyloxy, as well as corresponding branched isomers; and also phenyl which may be substituted by alkyl or alkoxy, each of 1 to 12 carbon atoms, or halogen. Typical examples of substituents of phenyl are methyl, ethyl, propyl, butyl, pentyl, hexyl, octyl, decyl and dodecyl, as well as corresponding branched isomers, the cited alkoxy radicals, as well as chloro and bromo.

Further, X and Y are each independently of the other a radical of formula $—COR_1$, $—CO_2R_1$, $—SO_2R_2$, $—P(O)(OR_3)_2$ or cyano. X and Y, when taken together, may also form a radical of formula $—CO—O—C_nH_{2n}—O—CO—$.

L is a divalent group of formula —CH= or —N=.

The substituent R is a group of formula

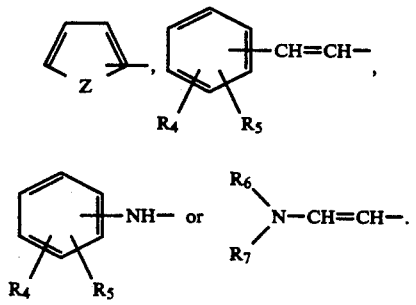

In the cited definitions, $R_1$ is, in addition to hydrogen, alkyl or alkenyl of 1 to 12 or 2 to 12 carbon atoms, respectively. Typical examples of such alkyl and alkenyl radicals are methyl, ethyl, propyl, butyl, hexyl, octyl, decyl, dodecyl, ethenyl, butenyl, heptenyl, octenyl, decenyl, undecenyl, as well as corresponding branched isomers and corresponding branched and unsaturated or polyunsaturated alkenyl radicals. $R_1$ may also be phenyl.

The index n is an integer from 1 to 5.

$R_2$ is, in addition to hydrogen, alkyl of 1 to 12 carbon atoms. Suitable alkyl radicals are exemplified in the definition of $R_1$. R2 may also be phenyl.

$R_3$ is alkyl of 1 to 12 carbon atoms. Suitable alkyl radicals are exemplified in the definitions of X and Y.

Z is, in addition to —NH—, also —O— or —S—.

The substituents $R_4$ and $R_5$ are each independently of the other hydrogen or alkyl or alkoxy, each of 1 to 12 carbon atoms. Suitable alkyl radicals are exemplified in the definition of $R_1$, and suitable alkoxy radicals may be derived therefrom. $R_4$ and $R_5$ may also be alkoxycarbonyl in which the alkoxy moiety contains 1 to 18 carbon atoms, and are typically—in addition to the previously cited alkoxy radicals $R_1$- tridecyloxy, pentadecyloxy, heptadecyloxy and octadecyloxy, as well as corresponding branched isomers. Further, $R_4$ and $R_5$ are also each independently of the other hydroxyl or halogen, such as chloro and bromo.

The substituents $R_6$ and $R_7$ are each independently of the other hydrogen or alkyl of 1 to 12 carbon atoms. Such alkyl radicals are exemplified in the definition of $R_1$.R6 and R7, together with the linking nitrogen atom, may also form a morpholine, piperidine or piperazine radical, In the compounds of formula (1) suitable for use in the practice of this invention, X and Y are preferably each independently of the other alkoxy of 1 to 4 carbon atoms, phenyl, phenyl which is substituted by alkyl or alkoxy, each of 1 to 4 carbon atoms, or by halogen, or are $—COR_1$, $—CO_2R_1$, $—SO_2R_2$, $—P(O)(OR_3)_2$ or cyano, or X and Y form a group of formula $—CO—O—C_nH_{2n}—O—CO—$, wherein $R_1$, $R_2$, $R_3$ and n have the given meanings. The substituent $R_3$ is preferably alkyl of 1 to 4 carbon atoms. Most suitably, $R_6$ and $R_7$ are hydrogen or alkyl of 1 to 12 carbon atoms, as well as the morpholine radical formed by these radicals together with the linking nitrogen atom.

Most preferably, X and Y are each independently of the other $—CO_2R_1$, $—SO_2R_2$ or cyano, or, when taken together, they form a group of formula $—CO—O—C_nH_{2n}—O—CO—$, where $R_1$, $R_2$ and n have the given meanings.

Preferably $R_4$ and $R_5$ are each independently of the other hydrogen, alkyl or alkoxy, each of 1 to 12 carbon atoms, hydroxyl or halogen, and $R_6$ and $R_7$ are each independently of the other alkyl of 1 to 12 carbon atoms.

A particularly suitable recording material is obtained when X and Y are each independently of the other $—CO_2R_1$, $—SO_2R_2$ or cyano, or, when taken together, form a group of formula $—CO—O—C_nH_{2n}—O—CO—$, $R_4$ and $R_5$ are each independently of the other hydrogen, alkyl or alkoxy, each of 1 to 4 carbon atoms, hydroxyl or chlorine, and R6 and $R_7$ are each independently of the other alkyl of 1 to 6 carbon atoms, and Z —O— or —S—, wherein $R_1$ is alkyl of 1 to 12 carbon atoms, n is an integer from 1 to 3 and $R_2$ is phenyl, and L has the given meaning.

Excellent results are obtained when X and Y are each independently of the other $—CO_2CH_3$—$CO_2C_2H_5$ or cyano, L is a goup of formula —N=, and R is a group of formula

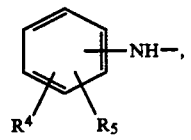

wherein $R_4$ and $R_5$ are each independently of the other hydrogen, methoxy or chlorine.

Depending on the recording material, the application of pressure or heat causes components (a) and (b) to come into contact with each other and to leave coloured images on the substrate. The colour is produced in accordance with the nature of components (a) and (b), which are the electron donor and form the chromogenic part. The colour formation is effected by component (b). An appropriate combination of the individual components is thus able to produce the desired colours, such as yellow, orange, red, violet, blue, green, grey, black or combination colours.

To use the compounds of formula (1) in a pressure-sensitive recording material, component (a) and component (c) [compounds of formula (1)] are dissolved jointly in an organic solvent, and the resultant solutions are conveniently encapsulated by the methods described, for example, in U.S. Pat. Nos. 2,712 507, 2,800 457, 3,016,308, 3,429,827 and 3,578,605, or in British patent specifications 989 264, 1 156 725, 1 301 052 or 1 355 124. Besides the use of gelatin as capsule material, microcapsules which are formed by interfacial polymerisation, for example capsules of polyester, polycarbonate, polysulfonamide, polysulfonate, preferably, however, of polyamide, polyurea or polyurethane, are also suitable. The encapsulation is usually necessary to separate components (a) and (c) from component (b) and thus to prevent a premature colour formation. This separation can also be achieved by incorporating components (a) and (c) in foam-like, sponge-like or honeycomb-like structures.

Illustrative examples of suitable solvents are preferably non-volatile solvents such as a halogenated benzene, diphenyl or paraffin, for example chloroparaffin, trichlorobenzene, monochlorodiphenyl, dichlorodiphenyl, or trichlorodiphenyl; an ester such as dibutyl adipate, dibutyl phthalate, dioctyl phthalate, butylbenzyl adipate, trichloroethylphosphate, trioctyl phosphate, tricresyl phosphate; an aromatic ether such as benzylphenyl ether; hydrocarbon oils such as paraffin oil or kerosene, aromatic hydrocarbons, for example an alkylated derivative, for example an isopropyl, isobutyl, sec-butyl or tert-butyl derivative, of diphenyl, naphthalene or terphenyl, dibenzyltoluene, a partially hydrogenated terphenyl, a mono- to tetraalkylated diphenylalkane containing 1 to 3 carbon atoms in each of the alkyl moieties, dodecylbenzene, a benzylated xylene, phenyl xylyl ethane, or other chlorinated or hydrogenated condensed hydrocarbons. Mixtures of different solvents, especially mixtures of paraffin oils or kerosene and diisopropylnaphthalene or partially hydrogenated terphenyl, are often used to achieve an optimum solubility for the colour formation, a rapid and intense coloration, and a viscosity which is advantageous for the microencapsulation.

The microcapsules containing components (a) and (c) can be used for the production of a very wide range of known kinds of pressure-sensitive copying materials. The various systems differ substantially from one another in the arrangement of the capsules and of the colour reactants, and in the nature of the substrate.

A convenient assembly is that in which the encapsulated components (a) and (c) are in the form of a layer on the back of a transfer sheet and the developer (component (b)) is in the form of a layer on the face of a receiving sheet. The reverse assembly is also possible. Another assembly of the components is that wherein the microcapsules containing components (a) and (c) and the developer (component (b)) are in or on the same sheet, in the form of one or more individual layers, or are incorporated in the substrate.

To obtain the desired colour, the capsule material which contains components (a) and (c) can be mixed with other capsules which contain conventional colour formers. Similar results are obtained by encapsulating components (a) and (c) jointly with one or more conventional colour formers. Often several colour formers are used in the same capsule.

The capsules are preferably secured to the support by means of a suitable binder. As paper is the preferred substrate, these binders are principally paper-coating agents, typically gum arabic, polyvinyl alcohol, hydroxymethylcellulose, casein, methyl cellulose, dextran, starch or starch derivatives or polymer lances. These last mentioned substances are e.g. butadiene/styrene copolymers or acrylic homopolymers or copolymers.

The paper employed comprises not only nominal paper made from cellulose fibres, but also paper in which the cellulose fibres are replaced (partially or completely) by synthetic polymers. The substrate may also be a plastic sheet.

Pressure-sensitive recording material may also be composed such that it comprises a capsule-free layer which contains components (a) and (c) and a colour developing layer containing, as colour developer (component (b)), at least one inorganic metal salt, preferably a halide or a nitrate, such as zinc chloride, tin chloride, zinc nitrate or a mixture thereof.

A pressure-sensitive paper will nonreally contain 1 to 50 % by weight, preferably 2 to 10 % by weight, of the capsule content or of one or more colour tonners. Usually 0. 1 to 25 % by weight, preferably 0.2 to 10 % by weight, based on the amount of a UV absorber of formula (1) present in the capsule, will suffice to protect the recording material sufficiently from light.

The UV absorbers of formula (1) need not necessarily be present in the capsules to ensure sufficient light protection. For example, the UV absorbers may also be incorporated in the binder surrounding the capsules or in an additional separate protective layer. It is also possible to incorporate the UV absorbers in the substrate or the colour developer layer. They should always, however, come between the light source and the colour former to be protected. For the cited purposes, UV absorber concentrations of 1 to 200 mg/m$^2$, preferably of 10 to 400 mg/m$^2$ and, most preferably, of 50 to 400 mg/m$^2$, have been found suitable.

The compounds of formula (1) eligible for use in the practice of this invention are also very suitable for use in heat-sensitive recording materials for use in thermography. In this utility, components (a), (c) and (b) come into contact with one another when heated to form a colour and develop images on the substrate.

The heat-sensitive recording material normally comprises at least one substrate, components (a), (c) and (b) and, in some cases, also a binder. If desired, the recording material may additionally contain an activator or a sensitiser.

Thermoreactive recording systems typically comprise heat-sensitive recording and copying materials and papers. These systems are typically used for recording information, for example in computers, printers, facsimile or copying machines, or in medical and technical recording and measuring instruments, such as electrocardiographs. The image formation (marking) can also be effected manually with a heated pen. Laser beams can also be used to produce heat-induced marks.

The thermoreactive recording material can be composed such that components (a) and (c) are dispersed or dissolved in one binder layer and the developer (component (b)) is dissolved or dispersed in the binder in a second layer. An alternative method comprises dispersing all three components in the same layer. By means of heat the layer or layers are softened or fused, whereupon components (a), (c) and (b) come into contact with one another at the areas where heat is applied and the desired colour develops at once.

Components (a) and (c) may also be encapsulated in the thermoreactive recording material.

Fusible, film-forming binders are preferably used for the preparation of the heat-sensitive recording material. These binders are normally water-soluble, whereas components (a), (c) and (b) are insoluble in water. The binder should be able to disperse the three components at room temperature and fix them on the support.

Examples of binders which are soluble, or at least swellable, in water are hydrophilic polymers such as polyvinyl alcohol, alkali metal polyacrylates, hydroxyethyl cellulose, methyl cellulose, carboxmethyl cellulose, polyacrylamide, polyvinyl pyrrolidone, carboxylated butadiene/styrene copolymers, gelatin, starch, or esterified corn starch.

If components (a), (c) and (b) are in two or three separate layers, it is possible to use water-insoluble binders, i.e. binders which are soluble in non-polar or only weakly polar solvents, for example natural rubber, synthetic rubber, chlorinated rubber, polystyrene, styrene/butadiene copolymers, polymethylacrylates, ethyl cellulose, nitrocellulose or polyvinyl carbazole. The preferred assembly, however, is that in which all three components are contained in one layer in a water-soluble binder.

To ensure the stability of the heat-sensitive recording material or the density of the developed image, the material may be provided with an additional protective layer. Such protective layers consist as a rule of water-soluble and/or water-insoluble resins which are customary polymer materials or aqueous emulsions thereof.

Specific examples of water-soluble polymer materials are polyvinyl alcohol, starch, starch derivatives, cellulose derivatives such as methoxy cellulose, hydroxyethyl cellulose, carboxymethyl cellulose, methyl cellulose or ethyl cellulose, sodium polyacrylate, polyvinyl pyrrolidone, polyacrylamide/acrylate copolymers, acrylamide/acrylate/methacrylic acid copolymers, styrene/maleic anhydride copolymer alkali metal salts, isobutene/ maleic anhydride copolymer alkali metal salts, polyacrylamide, sodium alginate, gelatin, casein, water-soluble polyesters or carboxyl-modified polyvinyl alcohol.

The following water-insoluble resins may, if desired, be used in the protective coating in conjunction with the cited water-soluble polymer resins: polyvinyl acetate, polyurethanes, styrene/butadiene copolymers, polyacrylic acid, polyacrylates, vinyl chloride/vinyl acetate copolymers, vinyl alcohol/vinyl acetate/maleic acid terpolymers, polybutyl methacrylate, ethylene/vinyl acetate copolymers und styrene/butadiene/acrylate copolymers. The protective layer may also contain UV absorbers.

Both the thermoreactive coatings as well as the resin coatings may contain further modifiers. To enhance the degree of whiteness or the suitability of the recording material for the thermoprinting head and to prevent the heated nib or plate from sticking, these coatings may contain, for example, antioxidants, UV absorbers of this invention as well as those of the benzophenone or hydroxybenzotriazole type and mixtures thereof, solubilisers, talcum, titanium dioxide, zinc oxide, alumina, hydrated alumina, calcium carbonate (e.g. chalk), clays or also organic pigments, for example urea/formaldehyde polymers. So that the colour formation is effected only within a limited temperature range, it is possible to add substances such as urea, thiourea, diphenyl thiourea, acetamide, acetanilide, benzosulfanilide, bis(stearoyl)ethylenedianiide, stearamide, phthalic anhydride, benzyl benzyloxybenzoate, metal stearates such as zinc stearate, phthalonitrile, dibenzyl rerephthalate, dimethyl terephthalate or other suitable fusible products which induce the simultaneous melting of the colour foraier components and the developer.

Heat-sensitive recording materials preferably contain waxes, e.g. carnauba wax, montan wax, paraffin wax, microwax, polyethylene wax, condensates of higher fatty acid amides and formaldehyde, or condensates of higher fatty acids and ethylenediamine.

To improve the usefulness of the thermochromatic materials, the three components (a), (c) and (b) can be encapsulated in microcapsules. To this end, any of the above mentioned per se known methods for encapsulating colour formers or other chemical agents in microcapsules can be employed.

The compounds of formula (1) can be used in conjunction with almost all colour tonners used in pressure-sensitive or heat-sensitive recording materials. Typical examples of such colour formers are 3,3-(bisaminophenyl)phthalides such as CVL, 3-indolyl-3-aminophenylaza- or -diazaphthalides, (3,3-bisindolyl)phthalides, 3,3-bis(1'-octyl-2'-methylindol-3'-yl)phthalide, 3,3-bis(p-dimethylaminophenyl)-6-dimethylaminophthalide, 3-aniinofluorans, 6-dialkylamino-2-dibenzylaminofluorans, 6-dialkylamino-3-methyl-2arylaminofluoranes, 3,6-bis(alkoxy)fluorans, 3,6-bis(-diarylamino)fluorans, 2-tert-butyl-6-diethylaniinofluoran, leucoauramines, spiropyrans, spirodipyrans, benzoxazines, chromenopyrazoles, chromenoindoles, phenoxazines, phenothiazines, quinazolines, rhodamine lactams, carbazolylmethanes, bis(4-N-methyl-N-phenylaminophenyl)-(1-n-butylcarbazol-3-yl)-methane and further triarylmethaneleuco dyes as well as preferably 2-N,N-dibenzylamino-5-diethylaminofluoran and 2-N,N-dibenzylamino-6diethylaminofluoran.

In the recording materials of this invention it is possible to use all inorganic or organic colour developers customarily used in recording materials and which are capable of attracting electrons (electron acceptors).

Typical examples of inorganic developers are activated clay substances such as attapulgus clay, acid clay, bentonite, monttnorillonite; activated clay such as acid-activated bentonite or montmorillonite as well as halloysite, kaolin, zeolith, silica, zirconium dioxide, alumina, aluminium sulfate, alurninium phosphate or zink nitrate.

Preferred inorganic colour developers are Lewis acids such as aluminium chloride, aluminium bromide, zink chloride, iron(HI) chloride, tin tetrachloride, tin dichloride, tin tetrabromide, titanium tetrachloride, bismuth trichloride, telluryl dichloride or antimony pentachloride.

The organic colour developers employed may be solid carboxylic acids, preferably aliphatic dicarboxylic acids such as tartaric acid, oxalic acid, maleic acid, citric acid, citraconic acid or succinic acid, as well as alkylphenol acetylene resin, maleic acid/rosin resin, carboxy polymethylene or a partially or completely hydrolysed polymer of maleic anhydride with styrene, ethylene or vinyl methyl ether.

Particularly suitable colour developers are compounds containing a phenolic hydroxyl group. These compounds may be monohydric and polyhydric phenols. These phenols may be substituted by halogen atoms, carboxyl groups, alkyl radicals, aralkyl radicals such as α-methylbenzyl, αα-dimethylbenzyl, aryl radicals, acyl radicals such as arylsulfonyl, or alkoxycarbonyl radicals or aralkoxycarbonyl radicals such as benzyloxycarbonyl Specific examples of phenols which are suitable for use as component (b) are: 4-tertbutylphenol, 4-phenylphenol, methylenebis(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenylsulfone, 4'-hydroxy-4-methyldiphenylsulfone, 4'-hydroxy-4isopropoxydiphenylsulfone, 4-hydroxyacetophenone, 2,4-dihydroxybenzophenone, 2,2'-dihydroxydiphenyl, 2,4-dihydroxydiphenylsulfone, 4,4'-cyclohexylidenediphenol, 4,4'-isopropylidenediphenol, 4,4'-isopropylidenebis(2-methylphenol), 4,4-bls(4-hydroxyphenyl)valeric acid, 1-phenyl-2,2-bis(4-hydroxyphenyl)butane, 1-phenyl-1,1-bis(-4hydroxyphenyl)butane, resorcinol, hydroquinone, pyrogallol, phloroglucinol, p-, m-, o-hydroxybenzoic acid, 3,5-di-(α-methylbenzyl)salicylic acid, 3,5-di(α, α-dimethylbenzyl)salicylic acid, salicylosalicylic acid, alkyl gallate, gallic acid, hydroxyphthalic acid, dimethyl hydroxyphthalate, 1-hydroxy-2-naphthoic acid or phenol/formaldehyde prepolymers which may also be modified with zink. The preferred cited carboxylic acids are the salicylic acid derivatives which are preferably used as zinc salts. Particularly preferred zinc salicylates are disclosed in EP-A-181 283 or DE-A-2 242 250.

Also particularly suitable for use as component (b) are organic complexes of zinc thiocyanate and, more particularly, an antipyrine complex of zinc thiocyanate, a pyridine complex of zinc thiocyanate or a cresidine complex of zinc thiocyanate as described in EP-A-97 620.

The developers may also be used in admixture with basically inert or almost inert pigment or other modifiers such as silica gel or UV absorbers such as 2-(2'-hydroxyphenyl)benzotriazoles, benzophenones, cyanoacrylates, or phenyl salicylates. Examples of such pigments are: talcum, fitanium dioxide, alumina, hydrated alumina, zink oxide, chalk, clays such as kaolin, as well as organic pigments, for example urea/formaldehyde condensates (BET surface area 2–75 $m^2/g$) or melamine/formaldehyde condensates.

The ratio of component (b) to components (a) and (c) depends on the nature of the three components, on the nature of the colour chance, on the colour reacfion temperature and, of course, also on the desired colour concentration.

The invention is illustrated by the following Example in which parts are by weight.

EXAMPLE 1

The following colour former composition is prepared:

| | |
|---|---|
| 18 parts | of 2-tert-butyl-6-diethylaminofluoran |
| 3 parts | of 3,3-bis(1'-octyl-2'-methylindol-3'-yl)phthalide |
| 16 parts | of 3,3-bis(p-dimethylaminophenyl)-6-dimethylaminophthalide |
| 13 parts | of bis(4-N-methyl-N-phenylamino-phenyl)-(1-n-butylcarbazol-3-yl)-methan |
| 50 parts | of 2-N,N-dibenzylamino-6-diethylaminofluoran |
| 100 parts | |

A neutral black colour is obtained with this composition in pressure-sensitive recording materials containing phenolic colour developers. 5 g of the composition are dissolved at 100° C. in 75 g of diisopropylnaphthalene and 20 g of kerosene. A second solution is prepared from 50 g of gelatin, 15 g of sodium dioctylsulphosuccinate, 1.5 g of octylphenylpoly(ethylene oxide 3EO) ether and water to a total weight of 1000 g.

0.1 g of compound of formula (1) is dissolved in 4.9 g of colour former solution. 1 g of this solution is mixed with 15 g of the gelatin solution and emulsified at 40° C. with ultrasonication.

The emulsion is applied in a 100 nm layer to polyethylene-coated paper and air-dried.

The materials are exposed daily to sunlight for 6 hours. After 3 days the red colouration is assessed by measuring the optical density, before and after exposure, with a Macbeth densitometer using a status A blue filter. The observed increase in blue density is proportional to the extent of the red colouration in the materials.

The following compounds of formula (1) are tested:

$(C_6H_{13})_2N-CH=CH-CH=C(CN)_2$ (E-1)

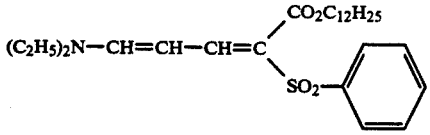
(E-2)

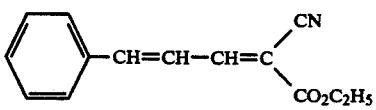
(E-3)

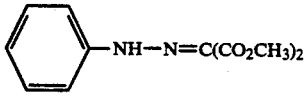
(E-4)

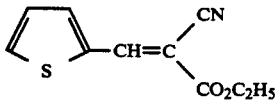
(E-5)

-continued

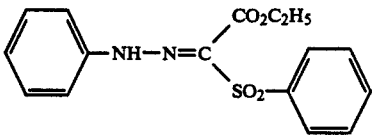
(E-6)

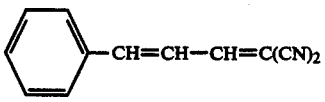
(E-7)

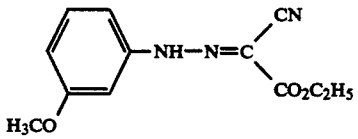
(E-8)

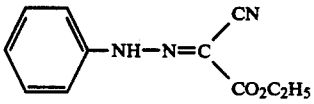
(E-9)

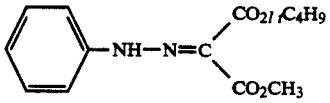
(E-10)

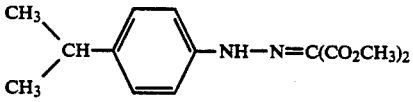
(E-11)

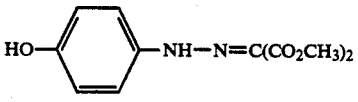
(E-12)

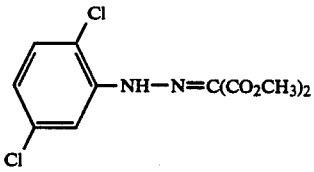
(E-13)

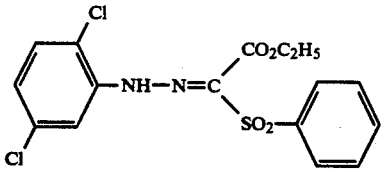
(E-14)

The results are reported in Table 1.

TABLE 1

| UV Absorber | 100 × increase in blue density after exposure times of 6 hours | 12 hours | 18 hours |
|---|---|---|---|
| — | 11 | 17 | 20 |
| E-1 | 2 | 7 | 8 |
| E-2 | 3 | 9 | 11 |
| E-3 | 4 | 10 | 13 |
| E-4 | 4 | 8 | 10 |
| E-5 | 3 | 9 | 12 |
| E-6 | 2 | 7 | 10 |
| E-7 | 4 | 10 | 13 |
| E-8 | 0 | 3 | 3 |
| E-9 | 0 | 3 | 5 |
| E-10 | 5 | 7 | 10 |

TABLE 1-continued

| UV Absorber | 100 × increase in blue density after exposure times of | | |
|---|---|---|---|
| | 6 hours | 12 hours | 18 hours |
| E-11 | 4 | 8 | 10 |
| E-12 | 4 | 8 | 8 |
| E-13 | 1 | 6 | 9 |
| E-14 | 4 | 10 | 12 |

The use of these UV absorbers in pressure-sensitive material clearly reduces the extent of the red colouration substantially.

The compounds of formula (1) which are suitable for use in the practice of this invention and which are described, inter alia, in DE-A-2 816 2262 U.S. Pat. No. 4,045,229 and U.S. Pat. No. 3,615,533 may be prepared as follows:

Compounds of the E-1 type:

20.1 g (0.085 mol) of N-(4,4-dicyano-1,3-butadienyl)-N-phenylacetamide and 34.1 g (0.18 mol) of freshly distilled di-n-hexylamine are heated to reflux in 100 ml of abs. ethanol. The initially yellowish suspension inir-

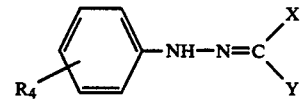

TABLE 2

| Compound | X | Y | $R_4$ | Physical data |
|---|---|---|---|---|
| E-6 | $-COOC_2H_5$ | $-SO_2-$ | $-H$ | m.p.: 136–138° C. |
| E-8 | $-CN$ | $-COOC_2H_5$ | m-$O-CH_3$ | m.p.: 87–88° C. |
| E-9 | $-CN$ | $-COOC_2H_5$ | $-H$ | m.p.: 109–111° C. |
| E-10 | $-CO-C(CH_3)_3$ | $-COOCH_3$ | $-H$ | m.p.: 88–90° C. |
| E-11 | $-COOCH_3$ | $-COOCH_3$ | -i-$C_3H_7$ | orange coloured oil elemental analysis: found: C = 60.68% H = 6.53% N = 9.78% cal.: C = 60.42% H = 6.52% N = 10.08% |
| E-12 | $-COOCH_3$ | $-COOCH_3$ | p-OH | m.p.: 169–171° C. |
| E-13 | $-COOCH_3$ | $-COOCH_3$ | o-Cl m-Cl | m.p.: 159–161° C. |
| E-14 | $-COOC_2H_5$ | $-SO_2-$ | o-Cl m-Cl | m.p.: 166–168° C. |

nediately forms a clear, dark red solution. After a reaction time of 1 hour at reflux, the reaction mixture is cooled and concentrated by evaporation, and the residue is distilled under a high vacuum. The yellowish orange solid product can be recrystallised from toluene after the preliminary purifying distillation, giving 9.4 g (38.5 % yield) of [3-(dihexylamino)-2-propenylidene]-propane dinitrile (E-1) as a pale yellow crystalline product of mp. 112°–113° C.

Compounds of the E-4 type 36.8 ml (0.4 mol) of aniline are suspended in 100 ml of water and to the suspension are added 120 ml of conc. hydrochloric acid while cooling to 0°–5° C. with ice/-water. A solution of 27.6 g of sodium nitrite in 100 ml of water is added dropwise over 30 minutes to the grey suspension, whereupon a dark yellow solution of the diazonium salt fomis. This solution is clarified with active charcoal and filtered over Hyflo (filter aid), and is further used direct in the form of a pale yellow solution.

To a solution of 131.2 g of sodium acetate in 250 ml of water and 194.5 ml of glacial acetic acid are added 46.7 ml (0.408 mol) of dimethyl malonate at 0°–5° C. Then the fresh diazonium salt solution of the aniline is added dropwise over 80 minutes. The solution tums yellow immediately. The batch is stirred for 4 hours after the dropwise addition and the resultant phenyl hydrazone (E-4) is extracted with 400 ml of toluene. The organic phase is washed with water and concentrated by evaporation. The dark yellow oily residue can be crystallised and recrystallised from hexane to give 40.0 g (44% yield) of E-4 with a melting point of 61°–63° C.

The following phenyl hydrazone derivatives are obtained with the compound of Table 1 in accordance with the procedure described above for obtaining compounds of the E-4 type, using different substituted aniline derivatives instead of dimethyl malonate for the coupling:

Compounds of the E-5 type 23 ml (0.25 mol) of thiophene-2-carbaldehyde and 26.6 ml (0.25 mol) of ethyl cyanoacetate and 0.45 g of β-alanine are dissolved with 2.9 ml of glacial acetic acid in 200 ml of toluene, and the solution is heated under nitrogen to reflux on a water separator. Spontaneous water separation commences and a clear yellow reaction mixture forms. After 3 hours the theoretical amount of water (4.5 ml) has separated. The reaction mixture is filtered hot over Tonsil AC and the product E-5 crystallises spontaneously from the cooled filtrate. The pale yellow crystals are filtered with suction and dried, to give 28.5 g (55 % yield) of product which melts at 92°–94° C.

EXAMPLE 2:

The Example illustrates how UV absorbers of the invention prevent the light-induced reddish discolouration of a microencapsulated colour former composition.

The colour formers listed below are dissolved in 95 g of a 2:1 mixture of diisopropylnaphthalene and kerosene (Exxsol ® D-100S):

0.55 g of Pergascript ® Orange I-5R
0.75 g of Pergascnptt ® Red I-6B
0.35 g of Pergascript ® Blue I-2R
0.75 g of Pergascript ® Blue S-RB
2.60 g of Pergascript ® Green I-2GN.

The colour former solution is microencapsulated as disclosed in U.S. Pat. No. 2,800,457 in gelatin by coacervation. The microcapsules are are thereafter dispersed in a starch solution and applied to copying paper in a dry coating weight of 5 g/m$^2$.

In similar manner, microcapsules which contain UV absorbers are prepared and applied to paper. In this case, however, 2.0 g of UV absorber are additionally dissolved in 93 g of the above diisopropylnaphthalene/-kerosene mixture together with the colour former.

After measuring the optical density (status A green filter) with a densitometer, the paper is exposed to light on the side coated with the microcapsules. Six daylight fluorescent tubes (Osram L 40 W/10S) spaced at a distance of 10 cm from tube centre to tube centre are used as light source. The distance between specimen and light source is also 10 cm. The optical density of the specimen is measured after exposure intervals of 2, 5, 10 and 20 seconds. An increase in the green density is observed. The increase in proportional to the red discolouration.

The results are reported in Table 3.

TABLE 3

| | 100 × increase in green density after exposure time of | | | |
|---|---|---|---|---|
| UV Absorber | 2 hours | 5 hours | 10 hours | 20 hours |
| — | 3 | 5 | 7 | 7 |
| E-1 | 2 | 2 | 4 | 5 |
| E-4 | 0 | 0 | 2 | 4 |

What is claimed is:

1. A pressure-sensitive or heat-sensitive recording material containing on at least one support (a) a colour former and (b) a colour developer, which comprises, additionally, as UV absorber (c), at least one compound of formula

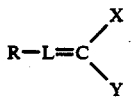

(1)

wherein

X and Y are each independently of the other —$COR_1$, —$CO_2R_1$, —$SO_2R_2$, —$P(O)(OR_3)_2$, cyano, alkoxy of 1 to 12 carbon atoms, phenyl or phenyl which is substituted by alkyl or alkoxy, each of 1 to 12 carbon atoms, or halogen; or, when taken together, X and Y form a group of formula —CO—O—$C_nH_{2n}$—O—CO—, L is a group of formula —CH= or —N=, and

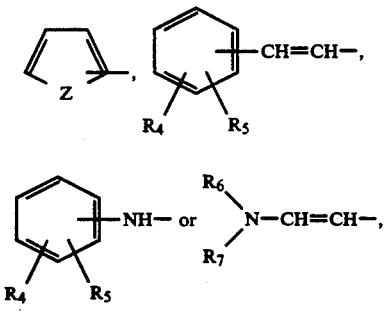

wherein $R_1$ is hydrogen, alkyl of 1 to 12 carbon atoms, alkenyl of 2 to 12 carbon atoms or phenyl, n is an integer from 1 to 5, $R_2$ is hydrogen, alkyl of 1 to 12 carbon atoms or phenyl, $R_3$ is alkyl of 1 to 12 carbon atoms, Z is —NH—, —O— or —S—, $R_4$ and $R_5$ are each independently of the other hydrogen, alkyl or alkoxy, each of 1 to 12 carbon atoms, alkoxycarbonyl containing 1 to 18 carbon atoms in the alkoxy moiety, hydroxyl or halogen, and $R_6$ and $R_7$ are each independently of the other hydrogen, alkyl of 1 to 12 carbon atoms or, together with the linking nitrogen atom, form a morpholine, piperidine or piperazine radical.

2. A recording material according to claim 1, wherein X and Y are each independently of the other —$COR_1$, $CO_2R_1$, —$SO_2R_2$, —$P(O)(OR_3)_2$, cyano, alkoxy of 1 to 4 carbon atoms, phenyl or phenyl which is substituted by alkyl or alkoxy, each of 1 to 4 carbon atoms, or halogen; or, when taken together, X and Y form a radical of formula —CO—O—$C_nH_{2n}$—O—CO—, and $R_1$, $R_2$, $R_3$ and n are as defined in claim 1.

3. A recording material according to claim 1, wherein X and Y are each independently of the other —$CO_2R_1$, —$SO_2R_2$ or cyano, or, when taken together, form a group of formula —CO—O—$C_nH_{2n}$—O—CO—, where $R_1$, $R_2$ and n are as defined in claim 2.

4. A recording material according to claim 1, wherein $R_3$ is alkyl of 1 to 4 carbon atoms.

5. A recording material according to claim 1, wherein $R_6$ and $R_7$ are each independently of the other hydrogen or alkyl of 1 to 12 carbon atoms or, together with the linking nitrogen atom, for a morpholine radical.

6. A recording material according to claim 5, wherein $R_6$ and $R_7$ are each independently of the other alkyl of 1 to 12 carbon atoms.

7. A recording material according to claim 1, wherein $R_4$ and $R_5$ are each independently of the other hydrogen, alkyl or alkoxy, each of 1 to 12 carbon atoms, hydroxyl or halogen.

8. A recording material according to claim 1, wherein X and Y are each independently of the other —$CO_2R_1$, —$SO_2R_2$ or cyano, or, when taken together, form a group of formula —CO—O—$C_nH_{2n}$—O—CO—, $R_4$ and $R_5$ are each independently of the other hydrogen, alkyl or alkoxy, each of 1 to 4 carbon atoms, hydroxyl or chlorine, and $R_6$ and $R_7$ are each independently of the other alkyl of 1 to 6 carbon atoms, and Z is —O— or —S—, wherein $R_1$ is alkyl of 1 to 12 carbon atoms, n is an integer from 1 to 3, and $R_2$ is phenyl, and L is as defined in claim 1.

9. A recording material according to claim 8, wherein X and Y are each independently of the other $—CO_2CH_3$, $—CO_2C_2H_5$ or cyano, L is a group of formula —N=, and R is a group of formula

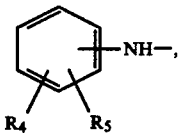

wherein $R_4$ and $R_5$ are each independently of the other hydrogen, methoxy or chlorine.

10. A recording material according to claim 1, which is pressure-sensitive.

11. A recording material according to claim 10, wherein components (a) and (c) are encapsulated in microcapsules.

12. A recording material according to claim 10, comprising a transfer sheet, the back of which contains components (a) and (c), and a receiving sheet, the face of which contains component (b).

13. A recording material according to claim 1, which is heat-sensitive.

14. A recording material according to claim 13, which comprises a layer containing components (a) and (c) and a layer containing component (b).

15. A recording material according to claim 13, which comprises a layer containing components (a), (c) and (b).

16. A recording material according to claim 1, wherein component (a) is 2-N,N-dibenzylamino-6-diethylaminofluoran.

17. A method of protecting pressure-sensitive or heat-sensitive recording materials against light-induced degradation said pressure-sensitive or heat-sensitive recording materials containing on at least one support (a) a color former and (b) a color developer, which comprises incorporating therein as a UV absorber at least one compound of formula (1) according to claim 1.

* * * * *